US006695574B1

(12) United States Patent
Mather

(10) Patent No.: US 6,695,574 B1
(45) Date of Patent: Feb. 24, 2004

(54) ENERGY ABSORBER AND DEFLECTION DEVICE

(75) Inventor: Robert Mather, Montreal, CA (US)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 10/224,456

(22) Filed: Aug. 21, 2002

(51) Int. Cl.[7] ..... F01D 21/00
(52) U.S. Cl. ..... 415/9; 415/121.2; 415/126
(58) Field of Search ..... 415/9, 121.2, 126; 60/39.091

(56) References Cited

U.S. PATENT DOCUMENTS 3,465,950 A * 9/1969 Freid et al. ..... 55/306
4,197,052 A 4/1980 Lardellier
4,503,667 A * 3/1985 Roberts ..... 60/39.091
4,505,104 A * 3/1985 Simmons ..... 60/39.091
5,622,472 A * 4/1997 Glowacki ..... 415/9
6,206,631 B1 3/2001 Schilling
6,227,794 B1 5/2001 Wojtyczka et al.

FOREIGN PATENT DOCUMENTS

WO WO 92/07180 4/1992

* cited by examiner

*Primary Examiner*—Ninh H. Nguyen
(74) *Attorney, Agent, or Firm*—Ogilvy Renault

(57) ABSTRACT

An energy absorber and deflection device for deflecting engine debris fragments from their tangential trajectory from a core of a gas turbine engine. The device includes a deflection plate radially spaced from a protected portion of the periphery of the rotor, adapted to cover the protected portion in a closed position, and to swing open about a fore edge of the deflection plate to a deployed position. A flexible joint secures the fore edge of the deflection plate to the engine and a frangible joint secures an aft edge of the deflection plate to the engine. In the case of a turbofan engine, the deflector plate may form part of the inner bypass duct surface to deflect debris to exit aft through the bypass duct, and in turboshaft and turboprop engines the deflector plate serves to deflect debris and reduce debris velocity to contain debris within the engine cowling or nacelle.

5 Claims, 3 Drawing Sheets

ENERGY ABSORBER AND DEFLECTION DEVICE

TECHNICAL FIELD

The invention relates to an energy absorber and hinged deflection plate for deflecting engine debris fragments from their potentially dangerous tangential trajectory from a core of a gas turbine engine to an aft direction to avoid uncontrolled impact with adjacent portions of the aircraft and surrounding environment.

BACKGROUND OF THE ART

The operation of a gas turbine engine involves the possibility of catastrophic failure of rotating components such as turbine hubs, turbine blades, portions of the rotating shaft as well forward fan blade fragments or compressor components. Since the velocities of revolution of turbines and other components in a gas turbine engine are relatively high, centrifugal forces acting on rotating components must be dealt with in the design of safety features for the engine.

Turbine rotor cracks, breaks or other malfunctions of the turbine can eventually result in disintegration if undetected and uncorrected. The high centrifugal force causes turbine debris to be expelled tangentially outwardly at a high velocity with substantial kinetic energy. To prevent catastrophic damage to surrounding airframe components, passenger cabins or instruments, containment rings or shrouds are generally provided radially outward of the turbines and other rotary components to impede the debris trajectory, absorb kinetic energy or deflect debris to prevent such damage.

For example, in International Publication WO 92/07180 a radial turbine containment system includes primary and secondary containment rings with a deflection ring to cooperatively interact and retain debris fragments within the plane of rotation of a turbine wheel.

Another example of retaining or deflecting of fan blade fragments is shown in U.S. Pat. No. 6,206,631 to Schilling. The fan casing surrounding the fan blades includes a deformable cantilevered inner shell with various types of frictional dampening devices to absorb the impact and deflect broken blade fragments.

It is an object of the present invention to absorb the energy and deflect rotating component debris fragments such as turbine blades and rotor fragments from their potentially dangerous tangential trajectory from the core of a gas turbine engine, preferably to a direction so as to exit along a path that will result in no hazardous secondary damage.

It is a further object of the invention to avoid the disadvantage of the prior art by containing and deflecting debris fragments through a bypass duct on a turbofan engine or within the exterior cowling of a turboprop or turboshaft engine rather than retaining such debris within the combustor or other adjacent engine core components.

Further objects of the invention will be apparent from review of the disclosure, drawings and description of the invention below.

DISCLOSURE OF THE INVENTION

The invention provides an energy absorber and deflection device for deflecting engine debris fragments from their tangential trajectory from a core of a gas turbine engine. The device includes a deflection plate radially spaced from a protected portion of the periphery of the rotor, adapted to cover the protected portion in a closed position, and to swing open about a fore edge of the deflection plate to a deployed position. A flexible joint secures the fore edge of the deflection plate to the engine and a frangible joint secures an aft edge of the deflection plate to the engine. In the case of a turbofan engine, the deflector plate may form part of the inner bypass duct surface to deflect debris to exit aft through the bypass duct, and in turboshaft and turboprop engines the deflector plate serves to deflect debris and reduce debris velocity to contain debris within the engine cowling or nacelle.

DESCRIPTION OF THE DRAWINGS

In order that the invention may be readily understood, an embodiment of the invention as applied to a turbofan engine with a bypass duct is illustrated by way of example in the accompanying drawings.

Further details of the invention and its advantages will be apparent from the detailed description included below.

DETAILED DESCRIPTION OF PREFERRED EMBODIMENTS

Figure 1:
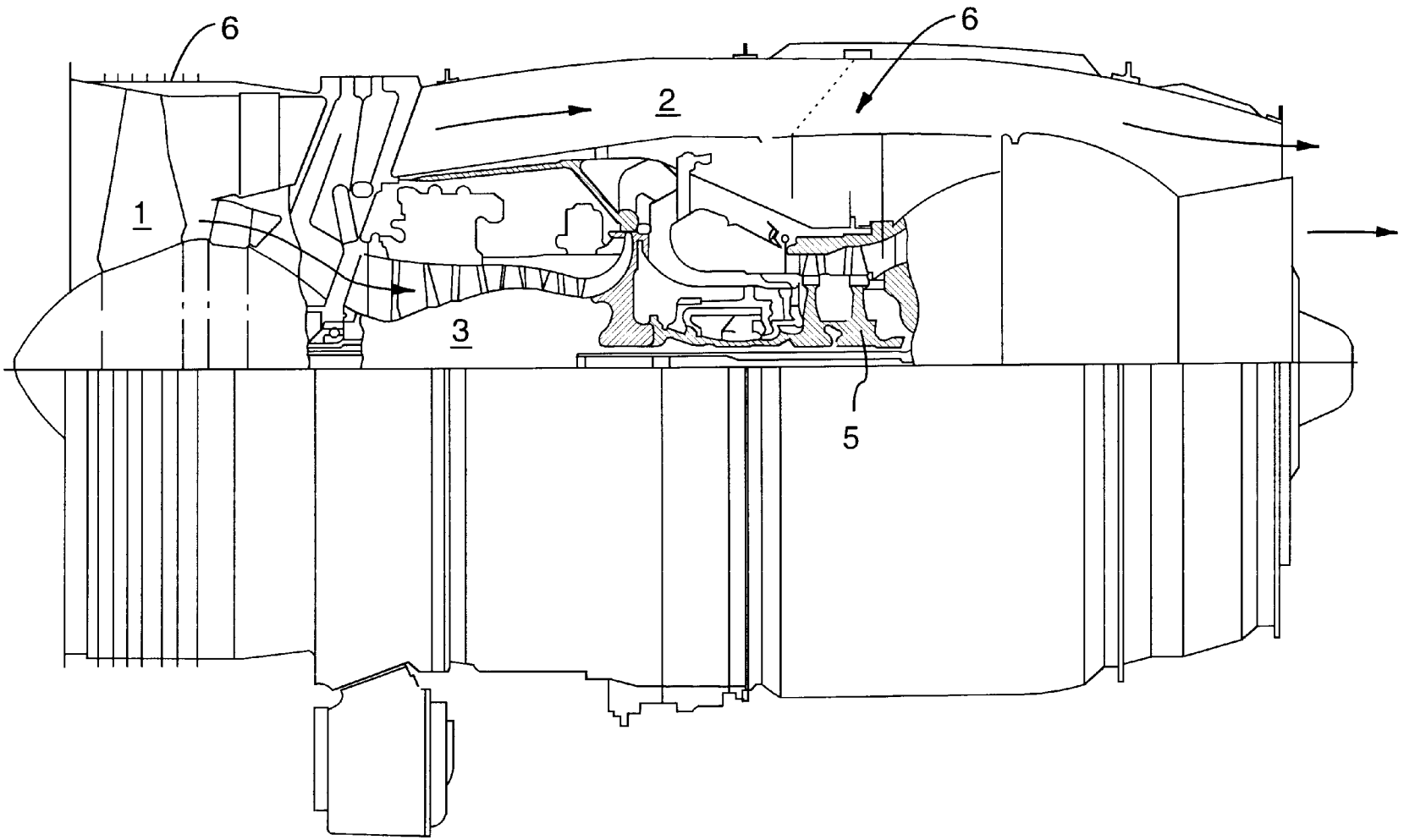
FIG. 1 is a partial axial cross-sectional view through a typical turbofan engine showing the energy absorber and deflection device disposed about the high pressure turbines downstream of the combustor in a closed position and showing in dashed outline the deflector plate in a deployed position within the bypass duct.

FIG. 1 shows a typical axial cross-sectional view through a turbofan engine. It will be understood that the invention is equally applicable to turboshaft and turboprop engines that do not have a bypass duct. In turboshaft and turboprop engines the deflector plate may be mounted on reinforcing hoops external to the engine core to deflect debris and reduce debris velocity to contain debris within the engine cowling or nacelle.

In the turbofan example illustrated, intake air passes over rotating fan blades 1 within fan casing 6 and is split into a bypass flow that progresses through bypass duct 2 and an internal core airflow that passes through low pressure axial compressor 3 and centrifugal compressor into the combustor 4. Fuel is injected and ignited within the combustor and hot gases pass over turbines 5 to be ejected through the rear exhaust portion of the engine.

Figure 2:
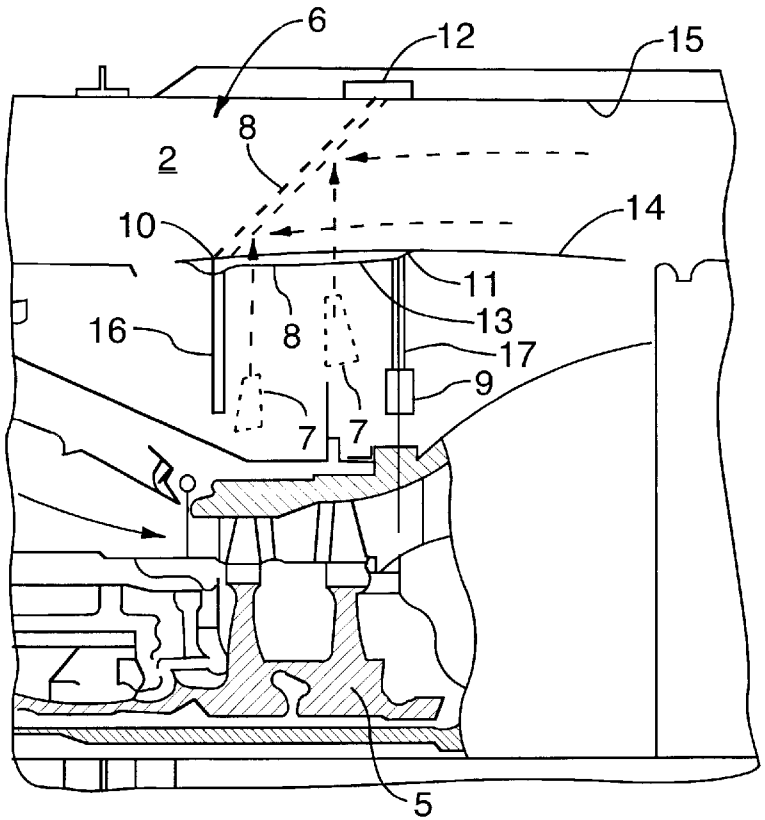
FIG. 2 is a detailed axial cross-sectional view showing the deflection plate in a closed position and in dashed outline showing the deflection plate in a deployed position to deflect blade fragments or other turbine debris aft through the bypass duct.

FIG. 2 shows an example of the invention applied to contain and deflect broken turbine rotor fragments such as the blade fragments 7 shown in the example. It will be understood however that any rotating components may be surrounded by a similar device to contain fan blade fragments, rotor fragments, broken shaft fragments, compressor fragments or as the example shows turbine blade fragment 7 or turbine rotor fragments after a catastrophic failure.

Figure 4:
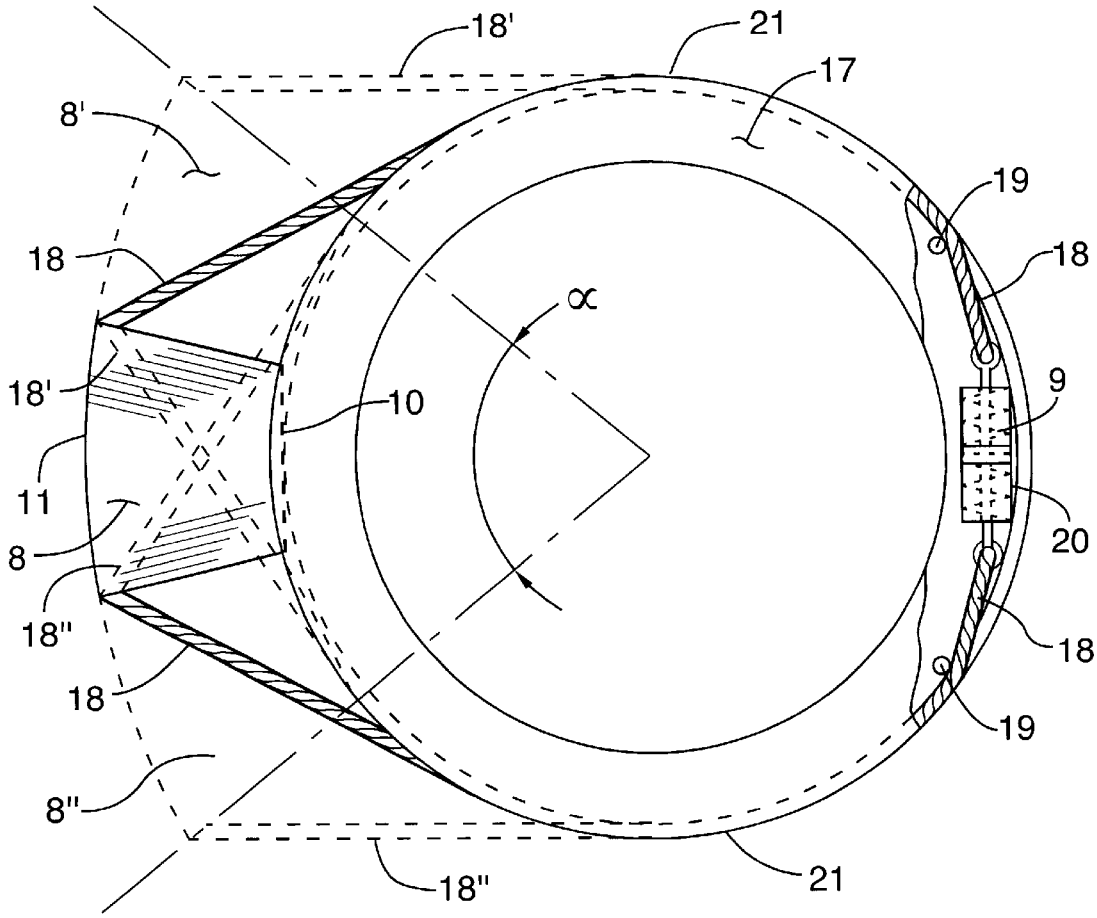
FIG. 4 is a like radial section view showing the operation of a spring loaded energy absorbing cylinder device connected with a tension cable to the aft edge of the open deflector plate.

The energy absorber and deflection device 6 is provided for deflecting any engine debris fragments from their tangential trajectory from the core of the gas turbine engine. In the embodiment illustrated the turbofan engine has an annular bypass duct 2 and a turbine rotor 5 mounted within the core of the engine for rotation about its longitudinal axis. As shown in FIG. 4, the entire periphery of the engine need not be protected since coverage of angle $\alpha$ is sufficient to deflect debris away from a trajectory that would damage the adjacent aircraft or puncture the passenger cabin for example. Depending on the engine location, the value of coverage angle $\alpha$ may vary between 15 to 30 degrees to cover critical areas to a full 360 degrees if necessary.

Figure 3:
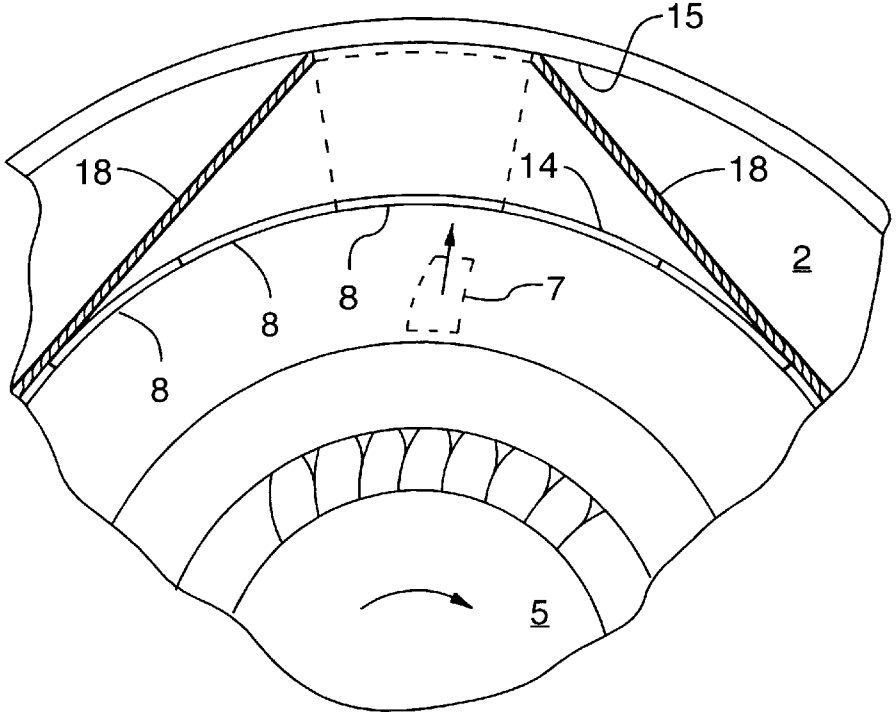
FIG. 3 is a radial cross-sectional view along line 3—3 of FIG. 2.

The deflection plate 8 is radially spaced from a portion of the periphery of the turbine rotor 5 and covers a debris exit port 13 within an inside wall 14 of the bypass duct 2 when in a closed position, as shown in FIGS. 2 and 3. The deflection plate 8, as shown in dashed outline in FIGS. 2 and 3, also swings open about a fore edge 10 of the deflection plate 8 to a deployed position.

A flexible joint such as a hinge or deformable strip of material is secured to the fore edge 10 of the deflection plate 8 joining a fore edge of the debris exit port 13. A frangible joint secures an aft edge 11 of the deflection plate 8 with an aft edge 11 of the debris exit port 13. In a preferred turbofan embodiment, a limit stop pad 12 within the outer wall 15 of the bypass duct 2 is provided to arrest the rotation of the aft edge 11 of the deflection plate 8 in the deployed position, as shown in dashed outline in FIGS. 2 and 3.

The flexible joint on the fore edge 10 may be mounted to a fore reinforcing hoop 16 which serves to support the deflection plate 8, reinforce the adjacent engine core structure and also to axially contain any blade fragments 7 or rotor fragments within a controlled annular space to impact and open the deflection plate 8. In addition, the frangible joint on the aft edge 11 may be mounted to an aft reinforcing hoop 17 in a like manner to support the deflection plate 8, contain the fragments 7 within a controlled space and further to reinforce the adjacent area of the engine core. An energy absorbing device 9 may be provided to engage the frangible joint in order to reduce the effect of impact and distribute the force of impact throughout the aft reinforcing hoop 17. Suitable energy absorbing devices will include flexible springs, ballistic fabric structures, hydraulic cylinders, pneumatic cylinders, or frangible honeycomb structures for example.

FIG. 4 shows two pistons that are biased with springs 20 within a cylinder as an energy absorbing device. The pistons are connected to a tensile cable 18 that runs over idler rollers 19 and through a peripheral groove 21 in the aft reinforcing hoop 17. When debris 7 forces the deflecting plate 8 open, the cable 18 stretches a certain degree absorbing energy and transfers the force of impact to the spring loaded energy absorbing device 9. Therefore, when turboshaft and turboprop engines having no bypass duct are fitted with the invention, the cable 18 and energy absorbing device 9 absorb the entire force of impact, while in the case of a turbofan engine, the limit stop pad 12 in the outer wall 15 of the bypass duct 2 may assist in absorbing impact energy. The cable 18 may comprise a ballistic fabric or elastic fibre. The spring 20 may be replaced by hydraulic fluid, or compressible gas to provide biased resistance. Alternatively a crushable or frangible honeycomb matrix material may replace the spring 20. Other energy absorbing devices 9 are within the contemplation of the invention.

In the embodiments shown in FIGS. 2 and 3, the inside wall 14 of the bypass duct 2 includes a peripheral array of multiple deflection plates 8. When debris fragments 7 engage the deflection plate 8 in a closed position, a portion of the localized kinetic energy is absorbed and distributed by the energy absorbing device 9 and flexural stiffness of the hoops 16 and 17. Small debris fragments 7 may be contained without rupture of the frangible joint on aft edge 11. However, larger fragments 7 with higher kinetic energy rupture the frangible joint and swing the deflection plate 8 to the deployed position shown in FIG. 2 about the flexible joint on the fore edge 10. Engagement between the aft edge 11 of the deflection plate 8 and the limit stop pad 12 restrains the rotation of the deflection plate 8 which serves to deflect the debris fragments 7 from their tangential trajectory to a rearward axial trajectory through the bypass duct 2 and engine exhaust.

As shown in FIG. 4, multiple deflector plates 8, 8' and 8" may be engaged on a single cable 18 or on individual cables 18, 18' and 18" to absorb energy in a like manner when debris strikes any one or all of the individual deflector plates 8, 8' or 8". The velocity of airflow through the bypass duct 2 or the recoil of the spring 20 and cable 18 under tension will partially or fully rotate the deflection plate 8 towards its closed position after the debris 7 has cleared.

Although the above description relates to a specific preferred embodiment as presently contemplated by the inventor, it will be understood that the invention in its broad aspect includes mechanical and functional equivalents of the elements described herein.

I claim:

1. An energy absorber and deflection device for deflecting engine debris fragments from their tangential trajectory from a core of a gas turbine engine, the engine having a rotor mounted within the core for rotation about a longitudinal axis, the device comprising:

a deflection plate radially spaced from a protected portion of the periphery of the rotor, the deflection plate: adapted to cover said portion in a closed position; and to swing open about a fore edge of the deflection plate to a deployed position;

a flexible joint securing the fore edge of the deflection plate to the engine; and a frangible joint securing an aft edge of the deflection plate to the engine.

2. An energy absorber and deflection device according to claim 1 including a limit stop pad within an outer wall of a bypass duct wherein the aft edge of the deflection plate engages the limit stop pad in said deployed position.

3. An energy absorber and deflection device according to claim 1 wherein the flexible joint is mounted to a fore reinforcing hoop.

4. An energy absorber and deflection device according to claim 1 wherein the frangible joint is mounted to an aft reinforcing hoop.

5. An energy absorber and deflection device according to claim 1 wherein the frangible joint engages an energy absorbing device selected from the group consisting of: a spring; ballistic fabric; a hydraulic cylinder; a pneumatic cylinder; and a frangible honeycomb structure.

* * * * *